US007694636B2

(12) United States Patent
Lin

(10) Patent No.: US 7,694,636 B2
(45) Date of Patent: Apr. 13, 2010

(54) FURNACE

(75) Inventor: Jung-Lang Lin, Taichung Hsien (TW)

(73) Assignee: Suncue Company Ltd., Taichung Hsien (TW)

( * ) Notice: Subject to any disclaimer, the term of this patent is extended or adjusted under 35 U.S.C. 154(b) by 396 days.

(21) Appl. No.: 11/847,596

(22) Filed: Aug. 30, 2007

(65) Prior Publication Data

US 2009/0056694 A1 Mar. 5, 2009

(51) Int. Cl.

| | |
|---|---|
| ***F23G 7/00*** | (2006.01) |
| ***C10J 3/34*** | (2006.01) |
| ***F23J 1/02*** | (2006.01) |
| ***F23B 90/00*** | (2006.01) |
| ***F23B 99/00*** | (2006.01) |
| ***B65G 25/00*** | (2006.01) |
| ***B66C 17/08*** | (2006.01) |
| ***F23H 15/00*** | (2006.01) |

(52) U.S. Cl. ..... 110/258; 110/165 R; 110/342; 414/153; 126/173

(58) Field of Classification Search ..... 110/258, 110/165 R, 170, 247, 222, 342, 225, 295; 366/248, 342, 343, 344, 247, 249, 331; 414/153; 126/173, 155, 182; 432/131; 165/93, DIG. 152, 165/DIG. 146; 15/236.1, 249.2, 93.1, 93.2, 15/93.4

See application file for complete search history.

*Primary Examiner*—Kenneth B Rinehart
*Assistant Examiner*—David J Laux
(74) *Attorney, Agent, or Firm*—Darby & Darby PC

(57) ABSTRACT

A furnace includes: a furnace housing; a perforated tray mounted in the furnace housing; and a stirring rod disposed rotatably on the perforated tray. The stirring rod has top and bottom ends, two opposite lateral ends, a middle portion, and opposite first and second portions, each of which extends from the middle portion to a respective one of the lateral ends. Each of the first and second portions has an inclined face that extends between the top and bottom ends of the stirring rod from the respective one of the lateral ends toward the middle portion of the stirring rod, that is inclined relative to the perforated tray, and that faces toward the perforated tray.

5 Claims, 4 Drawing Sheets

FURNACE

BACKGROUND OF THE INVENTION

1. Field of the Invention

This invention relates to a furnace, more particularly to a furnace including a stirring rod having an inclined face for stirring a combustible material on a perforated tray.

2. Description of the Related Art

A conventional furnace normally includes: a furnace housing; a perforated tray mounted in the furnace housing, dividing the inner space into upper and lower chambers, adapted to support a combustible material thereon, and formed with a plurality of apertures for passage of ash therethrough; a stirring rod disposed rotatably on the perforated tray for stirring the combustible material on the perforated tray; and a shaft extending through the perforated tray to connect with the stirring rod so as to drive rotation of the stirring rod using a motor.

In operation, the motor is actuated to drive rotation of the stirring rod, which results in stirring of the combustible material and ash formed from combustion of the combustible material on the perforated tray, which, in turn, results in falling of the ash through the apertures in the perforated tray to a bottom exit of the furnace.

Since there exists a gap between the perforated tray and the stirring rod, undesired accumulation of combustible material and ash in the gap is likely to occur, which can hinder rotation of the stirring rod.

SUMMARY OF THE INVENTION

Therefore, the object of the present invention is to provide a furnace that can overcome the aforesaid drawback associated with the prior art.

According to the present invention, a furnace comprises: a furnace housing defining an inner space therein; a perforated tray mounted in the furnace housing, dividing the inner space into upper and lower chambers, adapted to support a combustible material thereon, and formed with a plurality of apertures for passage of ash therethrough; and a stirring rod disposed rotatably on the perforated tray for stirring the combustible material on the perforated tray. The stirring rod has top and bottom ends, two opposite lateral ends, a middle portion, and opposite first and second portions, each of which extends from the middle portion to a respective one of the lateral ends. Each of the first and second portions has an inclined face that extends between the top and bottom ends of the stirring rod from the respective one of the lateral ends toward the middle portion of the stirring rod, that is inclined relative to the perforated tray, and that faces toward the perforated tray.

BRIEF DESCRIPTION OF THE DRAWINGS

In drawings which illustrate an embodiment of the invention.

DETAILED DESCRIPTION OF THE PREFERRED EMBODIMENT

Figure 1:
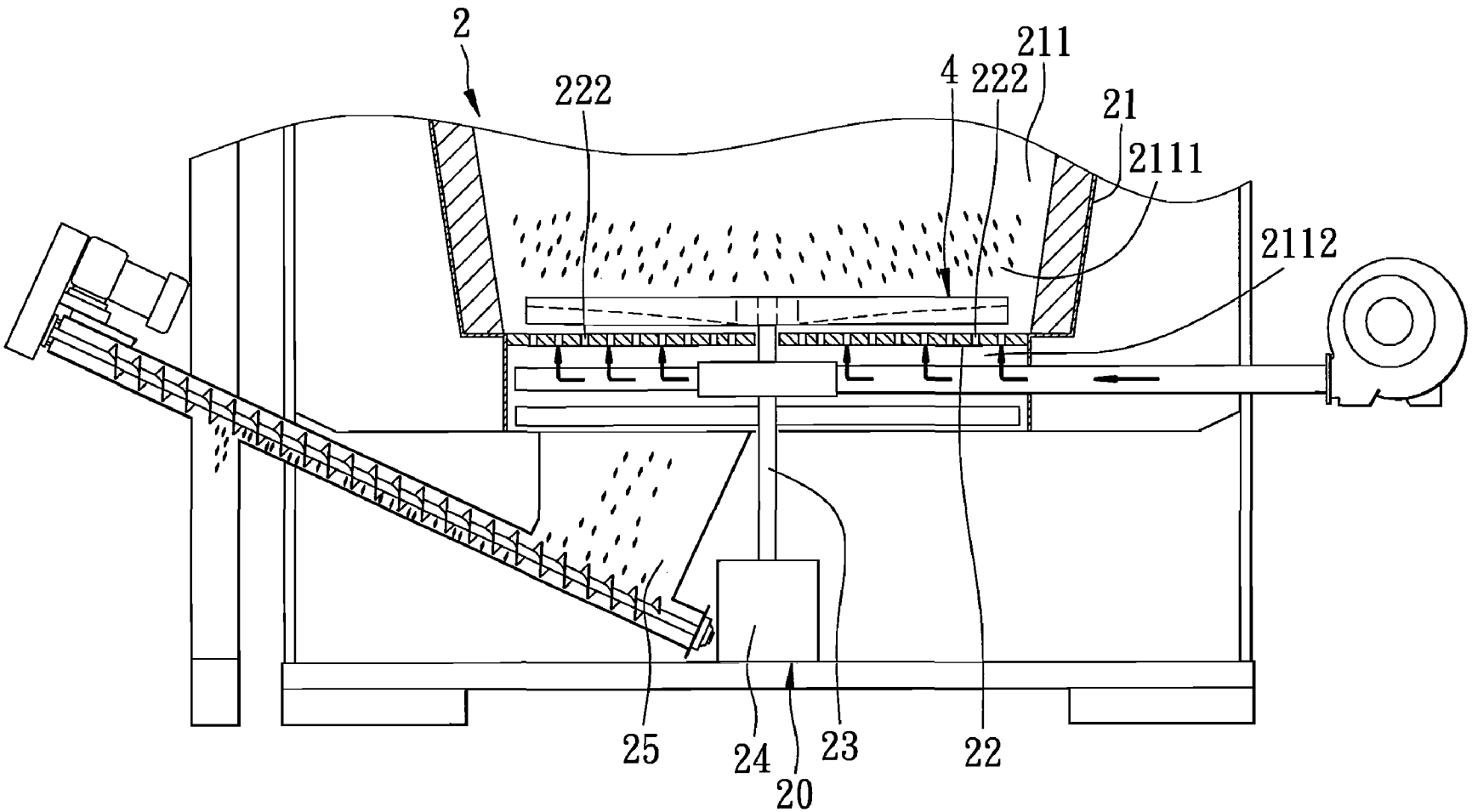
FIG. 1 is a fragmentary schematic partly sectional view of the preferred embodiment of a furnace according to this invention.
Figure 2:
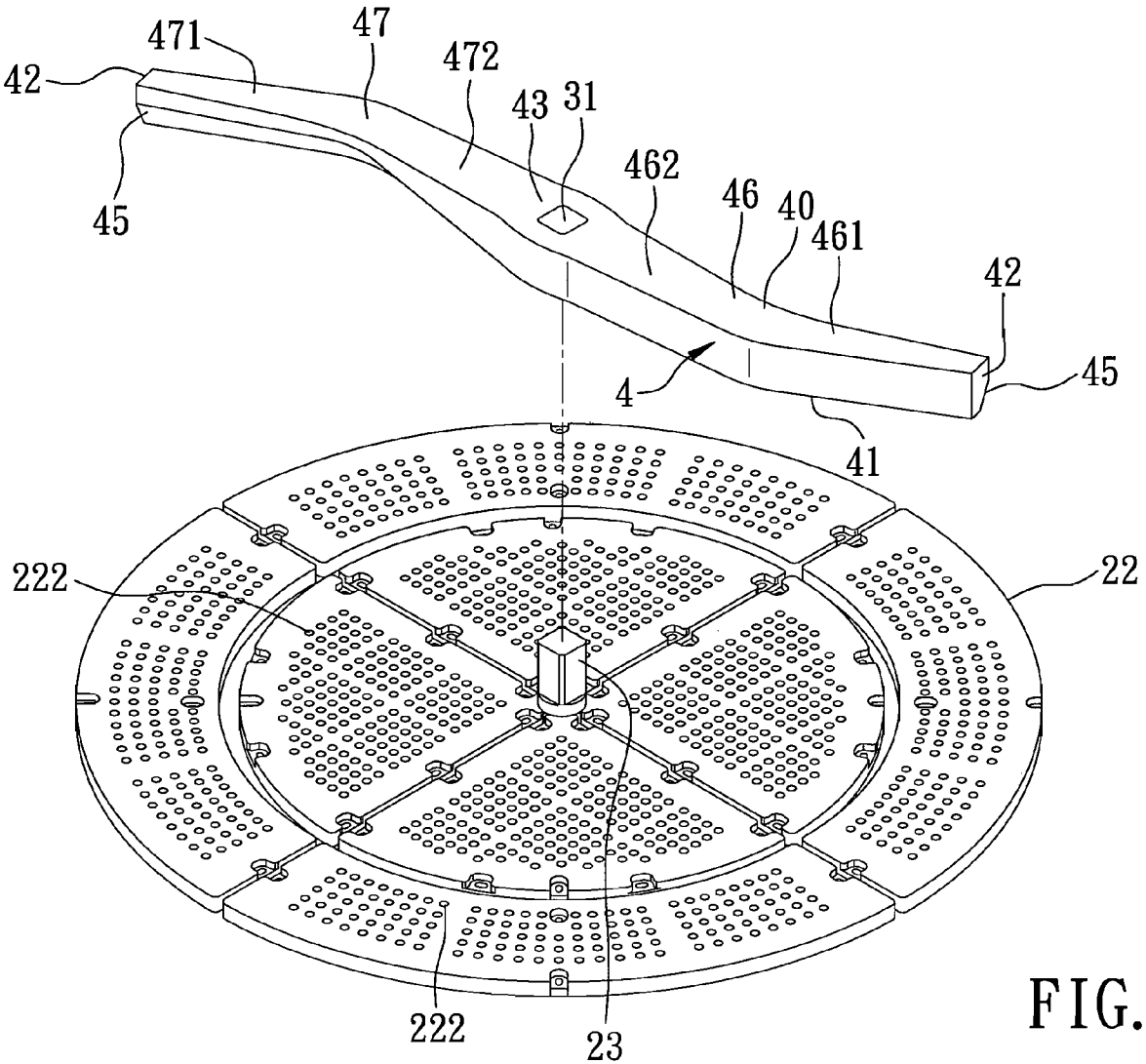
FIG. 2 is an exploded perspective view of an assembly of a perforated tray and a stirring rod of the preferred embodiment.
Figure 3:
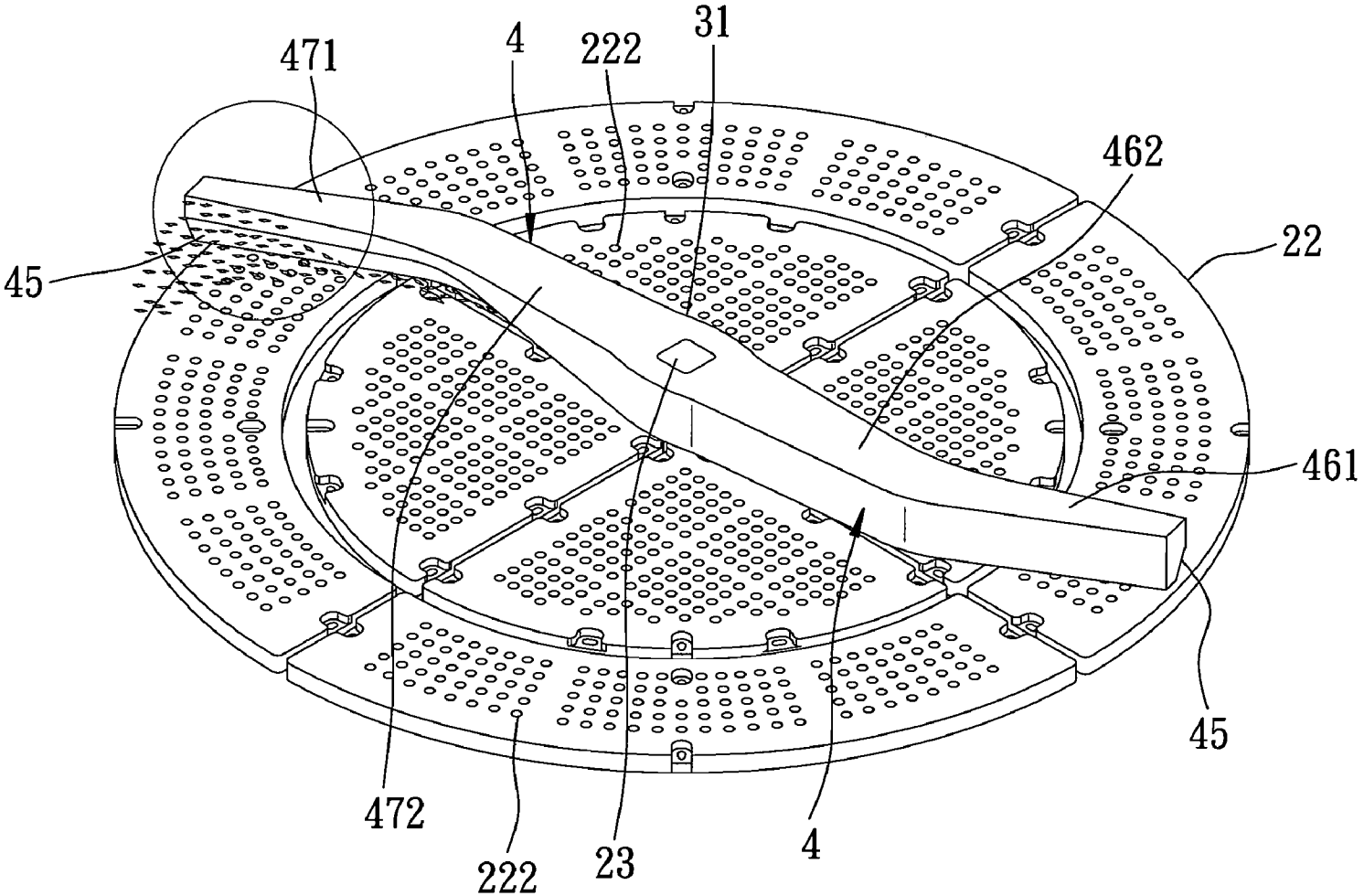
FIG. 3 is an assembled perspective view of the assembly of the perforated tray and the stirring rod of the preferred embodiment.
Figure 4:
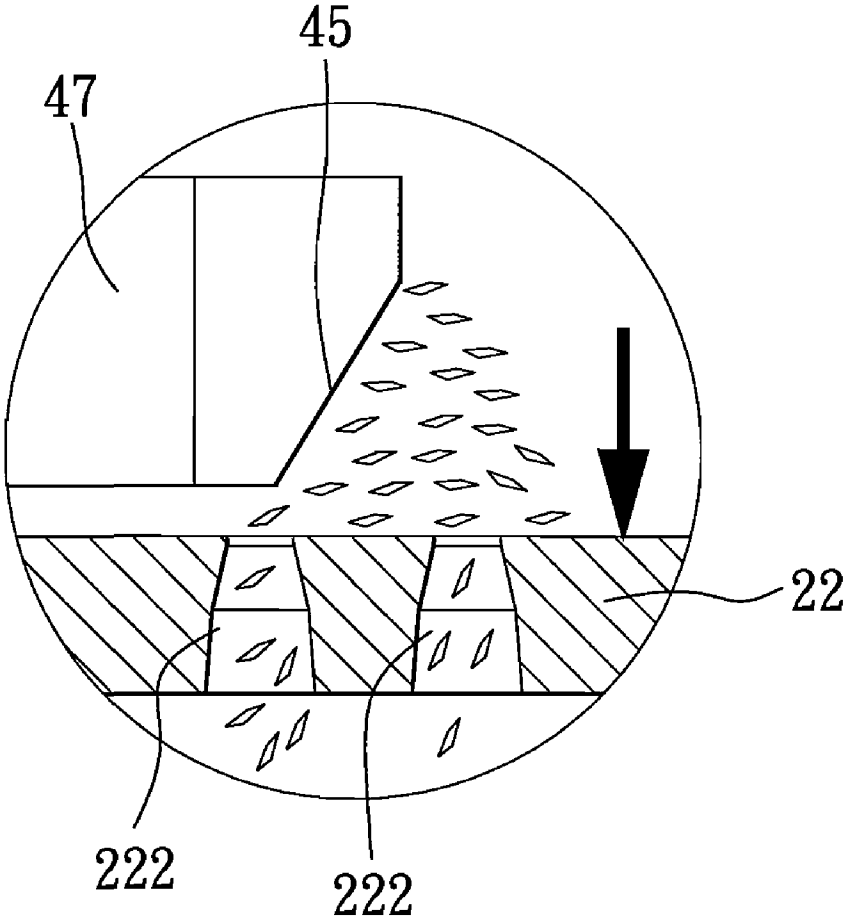
FIG. 4 is an enlarged partly sectional view of an encircled portion in FIG. 3.

FIGS. 1 to 4 illustrate the preferred embodiment of a furnace 2 of this invention for burning a raw material, such as hull and shell waste of agricultural crops.

The furnace 2 includes: a furnace housing 21 defining an inner space 211 therein; a perforated tray 22 mounted in the furnace housing 21, dividing the inner space 211 into upper and lower chambers 2111, 2112, adapted to support a combustible material thereon, and formed with a plurality of apertures 222 for passage of ash therethrough; and a stirring rod 4 disposed rotatably on the perforated tray 22 for stirring the combustible material on the perforated tray 22. The stirring rod 4 has top and bottom ends 40,41, two opposite lateral ends 42, a middle portion 43, and opposite first and second portions 46, 47, each of which extends from the middle portion 43 to a respective one of the lateral ends 42. Each of the first and second portions 46, 47 of the stirring rod 4 has an inclined face 45 that extends between the top and bottom ends 40,41 of the stirring rod 4 from the respective one of the lateral ends 42 toward the middle portion 43 of the stirring rod 4, that is inclined relative to the perforated tray 22, and that faces toward the perforated tray 22.

Each of the first and second portions 46, 47 of the stirring rod 4 further has an outer segment 461,471 extending from the respective one of the lateral ends 42 of the stirring rod 4, and an inner segment 462, 472 bent from the outer segment 461,471 and extending therefrom to the middle portion 43 of the stirring rod 4 such that the outer and inner segments 461, 462 (471, 472) of each of the first and second portions 46, 47 of the stirring rod 4 form an angle of less than 180 degrees and greater than 90 degrees therebetween. Preferably, each of the first and second portions 46, 47 of the stirring rod 4 is tapered from the middle portion 43 to the respective one of the lateral ends 42 of the stirring rod 4.

The furnace 2 further includes a driving unit 20 including a motor 24 with an output shaft 23 that extends through the perforated tray 22 and into the upper chamber 211 of the furnace 2. The middle portion 43 of the stirring rod 4 is formed with a non-circular hole 31 for extension of the output shaft 23 thereinto so as to permit the stirring rod 4 to be driven by the output shaft 23 of the motor 24.

In this embodiment, the inclined faces 45 of the first and second portions 46, 47 of the stirring rod 4 are disposed respectively at two opposite sides of the stirring rod 4.

In operation, the combustible material and ash are stirred by the stirring rod 4 upon actuation of the motor 24 so as to enhance combustion of the combustible material and to permit falling of the ash through the apertures 222 in the perforated tray 22 into a bottom exit 25 of the furnace 2 for further treatment. During rotation of the stirring rod 4, the inclined faces 45 of the first and second portions 46, 47 of the stirring rod 4 push the ash to pass through the apertures 222 in the perforated tray 22, thereby facilitating removal of the ash from the perforated tray 22 and reducing the accumulated amount of the ash in a gap between the stirring rod 4 and the perforated tray 22. Moreover, the angle between the inner and outer segments 461, 462 (471, 472) of each of the first and second portions 46, 47 of the stirring rod 4 enhances stirring and circulation of the combustible material and the ash on the perforated tray 22. Furthermore, the tapered shape of each of the first and second portions 46, 47 of the stirring rod 4 reduces the contact area of the respective inclined face 45 that is in contact with the combustible material and the ash, thereby reducing the resistance to rotation of the stirring rod 4 attributed to the combustion material and the ash.

With the inclusion of the stirring rod 4 in the furnace of this invention, the aforesaid accumulation problem associated with the prior art can be considerably alleviated.

With the invention thus explained, it is apparent that various modifications and variations can be made without departing from the spirit of the present invention. It is therefore intended that the invention be limited only as recited in the appended claims.

What is claimed is:

1. A furnace comprising:

a furnace housing defining an inner space therein;

a perforated tray mounted in said furnace housing, dividing said inner space into upper and lower chambers, adapted to support a combustible material thereon, and formed with a plurality of apertures for passage of ash therethrough; and a stirring rod disposed rotatably on said perforated tray for stirring the combustible material on said perforated tray, said stirring rod having top and bottom ends, two opposite lateral ends, a middle portion, and opposite first and second portions, each of which extends from said middle portion to a respective one of said lateral ends, each of said first and second portions having an inclined face that extends between said top and bottom ends of said stirring rod from the respective one of said lateral ends toward said middle portion of said stirring rod, that is inclined relative to said perforated tray, and that faces toward said perforated tray.

2. The furnace of claim 1, wherein each of said first and second portions of said stirring rod further has an outer segment extending from the respective one of said lateral ends of said stirring rod, and an inner segment bent from said outer segment and extending therefrom to said middle portion of said stirring rod.

3. The furnace of claim 1, wherein each of said first and second portions of said stirring rod is tapered from said middle portion to the respective one of said lateral ends of said stirring rod.

4. The furnace of claim 1, further comprising a driving unit including an output shaft that extends through said perforated tray and into said upper chamber of said furnace, said middle portion of said stirring rod being formed with a non-circular hole for extension of said output shaft thereinto so as to permit said stirring rod to be driven by said output shaft.

5. The furnace of claim 1, wherein said stirring rod further has two opposite sides, said inclined faces of said first and second portions of said stirring rod being disposed respectively at said opposite sides of said stirring rod.

* * * * *